US006889746B2

(12) United States Patent
Yanagimoto et al.

(10) Patent No.: US 6,889,746 B2
(45) Date of Patent: May 10, 2005

(54) MATERIAL FOR PLASTIC WORKING AND PRODUCTION METHOD THEREOF

(75) Inventors: Shigeru Yanagimoto, Kitakata (JP); Masashi Fukuda, Kitakata (JP); Tomoo Uchida, Kitakata (JP); Kunio Hirano, Kitakata (JP)

(73) Assignee: Showa Denko K.K., Tokyo (JP)

( * ) Notice: Subject to any disclaimer, the term of this patent is extended or adjusted under 35 U.S.C. 154(b) by 55 days.

(21) Appl. No.: 10/258,659

(22) PCT Filed: Feb. 28, 2002

(86) PCT No.: PCT/JP02/01858

§ 371 (c)(1),
(2), (4) Date: Oct. 28, 2002

(87) PCT Pub. No.: WO02/068141

PCT Pub. Date: Sep. 6, 2002

(65) Prior Publication Data

US 2003/0226652 A1 Dec. 11, 2003

(30) Foreign Application Priority Data

Feb. 28, 2001 (JP) ..... 2001-056028

(51) Int. Cl.[7] ..... B22D 27/04
(52) U.S. Cl. ..... 164/122.1; 164/126; 164/133
(58) Field of Search ..... 164/122.1, 126, 164/133; 148/437, 404, 688

(56) References Cited

U.S. PATENT DOCUMENTS 4,044,810 A * 8/1977 Taniguchi et al. ..... 152/209.14
5,769,147 A * 6/1998 Yanagimoto et al. .... 164/122.1
5,989,365 A * 11/1999 Yanagimoto et al. ..... 148/437

FOREIGN PATENT DOCUMENTS

| | | |
|---|---|---|
| JP | 54-42847 B2 | 12/1979 |
| JP | 63-154256 | 6/1988 |
| JP | 9-174198 | 7/1997 |

OTHER PUBLICATIONS

*"Effect of Si grain size on wear resistance of Al–Si powder alloy"*, 73rd Fall Conference of the Japan Institute of Light Metals (Nov. 1987).

* cited by examiner

*Primary Examiner*—Tom Dunn
*Assistant Examiner*—I.-H. Lin
(74) *Attorney, Agent, or Firm*—Sughrue Mion, PLLC

(57) ABSTRACT

A material for plastic working is produced by the steps of using a mold having a mold cavity (16) partially defined by an end surface of a stopper (13) for closing a molten metal inlet (101), teeming molten metal (10) into the mold cavity through the inlet and cooling the molten metal to thereby attain unidirectional solidification of the molten metal. Regulation of the cooling rate enables the mean grain size to be graded in the direction from the cooled face (B surface) to the opposing face (T surface) and the added components to increase in the same direction. It is possible to obtain a material for plastic working that has a selected portion exhibiting an excellent function.

5 Claims, 6 Drawing Sheets

(a)

| | DISTANCE FROM BOTTOM FACE (mm) | | |
|---|---|---|---|
| | 1 | 11 | 21 |
| | STRIP | SPIRAL | SMALL FRAGMENTS |
| CUT DUST |  |  |  |

(b)

| | STRIP |
|---|---|
| CUT DUST |  |

MATERIAL FOR PLASTIC WORKING AND PRODUCTION METHOD THEREOF

CROSS REFERENCE TO RELATED APPLICATION

This application is an application filed under 35 U.S.C. 111(a) claiming the benefit pursuant to 35 U.S.C. 119(e) (1) of the filing date of Provisional Application Ser. No. 60/276,502 filed Mar. 19, 2001 pursuant to 35 U.S.C. 111(b).

TECHNICAL FIELD

The present invention relates to a material for plastic working that has been solidified through unidirectional solidification and to a production process of such material making use of unidirectional solidification.

BACKGROUND ART

Material for plastic working, particularly that for forging, takes the form of a blank and is obtained by cutting a continuously cast rod or an extruded rod, or by blanking a rolled material.

Such material for forging is firstly made into a continuously cast rod of small diameter, which is obtained by continuous casting of molten metal, or into an ingot such as a billet for extrusion or a rolled slab.

The continuously cast rod of small diameter is subjected to homogenizing treatment, then to peeling for removing the cast surface and to cutting into blanks of predetermined thickness and predetermined length by use of a circular saw cutter to thereby produce a material for forging.

In the case of an extruded rod, the aforementioned billet is subjected to homogenizing treatment, then the treated material is extruded by an extruder, and drawn if necessary, and cut into blanks of predetermined thickness and predetermined length by use of a circular saw cutter to thereby produce a material for forging.

In the case of a rolled sheet, the aforementioned slab is subjected to homogenizing treatment, then the treated material is rolled with a hot rolling machine so as to yield a rolled sheet of desired thickness, followed by blanking to have a desired shape to thereby produce a material for forging.

The projection plane (cross-section) of any of these materials for forging is not necessarily round, but may be a centrally hollow circle, another shape resulting from profile extrusion, or any combination of these.

Material for plastic working has conventionally been produced through so-called direct chilling (casting employing forced cooling), in which cold water is applied directly to a cast ingot to thereby solidify the melt rapidly. This process attains a virtually uniform dispersion of solute elements.

However, when application of the material for plastic working to a functional member is desired, particularly in the case of application to a member required to have high strength and wear resistance, as typified by that made of high Si alloy, the material for plastic working must exhibit wear resistance in a specific portion at which the member being produced is brought into sliding contact with a counter member. Thus, wear resistance is not necessarily required for the entirety of the produced member.

For example, in the field of powder metallurgy, the relationship between the size of silicon grains and wear resistance is described in "*Effect of Si grain size on wear resistance of Al—Si powder alloy*" reported at the 73rd Fall Conference of the Japan Institute of Light Metals (November 1987).

Attempts have been made to obtain similar effects in the field of alloys produced from molten metal.

In relation to strength characteristics of alloys produced from molten metal, design of alloy components is directed to maintain the strength of a specific portion of a member to which a concentrated load is to be applied. However, in many cases, the strength tends to be imparted to the entirety of the member.

Thus, even when a required characteristic varies from portion to portion of a member, conventional material for plastic working has been used to give such a characteristic to portions other than the portion where the characteristic is required, because alloy components and metallographic alloy structure of the member are determined univocally so as to meet the requirement called for in relation to a specific portion.

Particularly in the case of an anti-wear alloy, added silicon (Si), which is added to serve as the secondary phase crystal alloy, crystallizes out in the course of solidification in the form of eutectic silicon or primary crystal silicon, and such crystallized silicon deteriorates workability of plastic deformation or machinability of the alloy.

The present invention has been made in order to overcome the above-described disadvantages, and its object is to provide a material for plastic working having an excellent function at a specific selected portion, by grading the inside compositional distribution and the metallographic morphology from the cooled face (bottom face) to the opposite face (top surface), as well as to provide a production method of the material.

DISCLOSURE OF THE INVENTION

The present invention is drawn to a material for plastic working produced by the steps of using a mold that has a mold cavity partially defined by an end surface of a stopper and cooling molten metal teemed into the mold cavity through a molten metal inlet to thereby attain unidirectional solidification of the molten metal, wherein at least one of mean grain size and mean length of secondary phase crystal grains present in the material increases in a direction from a cooled face to the end surface of the stopper, or wherein a concentration of at least one of additional components contained in the material increases in the direction.

The molten metal may be aluminum alloy.

The present invention is also directed to a method for producing a material for plastic working comprising the steps of using a mold that has a mold cavity partially defined by an end surface of a stopper and cooling molten metal teemed into the mold cavity through a molten metal inlet to thereby attain unidirectional solidification of the molten metal, wherein a cooling rate of the molten metal is monotonously reduced in a direction from a cooled face to the end surface of the stopper, except for a columnar portion which is coaxial with and present beneath the molten metal inlet and has a diameter 1.5 times to twice that of the molten metal inlet.

The molten metal may be aluminum alloy or aluminum-silicon-based alloy.

As described above, the inside compositional distribution and the metallographic morphology from the cooled face to the end surface of the stopper are graded to obtain a material for plastic working having an excellent mechanical function at a specific selected portion

BRIEF DESCRIPTION OF THE DRAWINGS

FIG. 8(*b*) shows the shape of cut dust in Comparative Example 1.

BEST MODES FOR CARRYING OUT THE INVENTION

Modes for carrying out the present invention will next be described with reference to the accompanying drawings.

Figure 1:
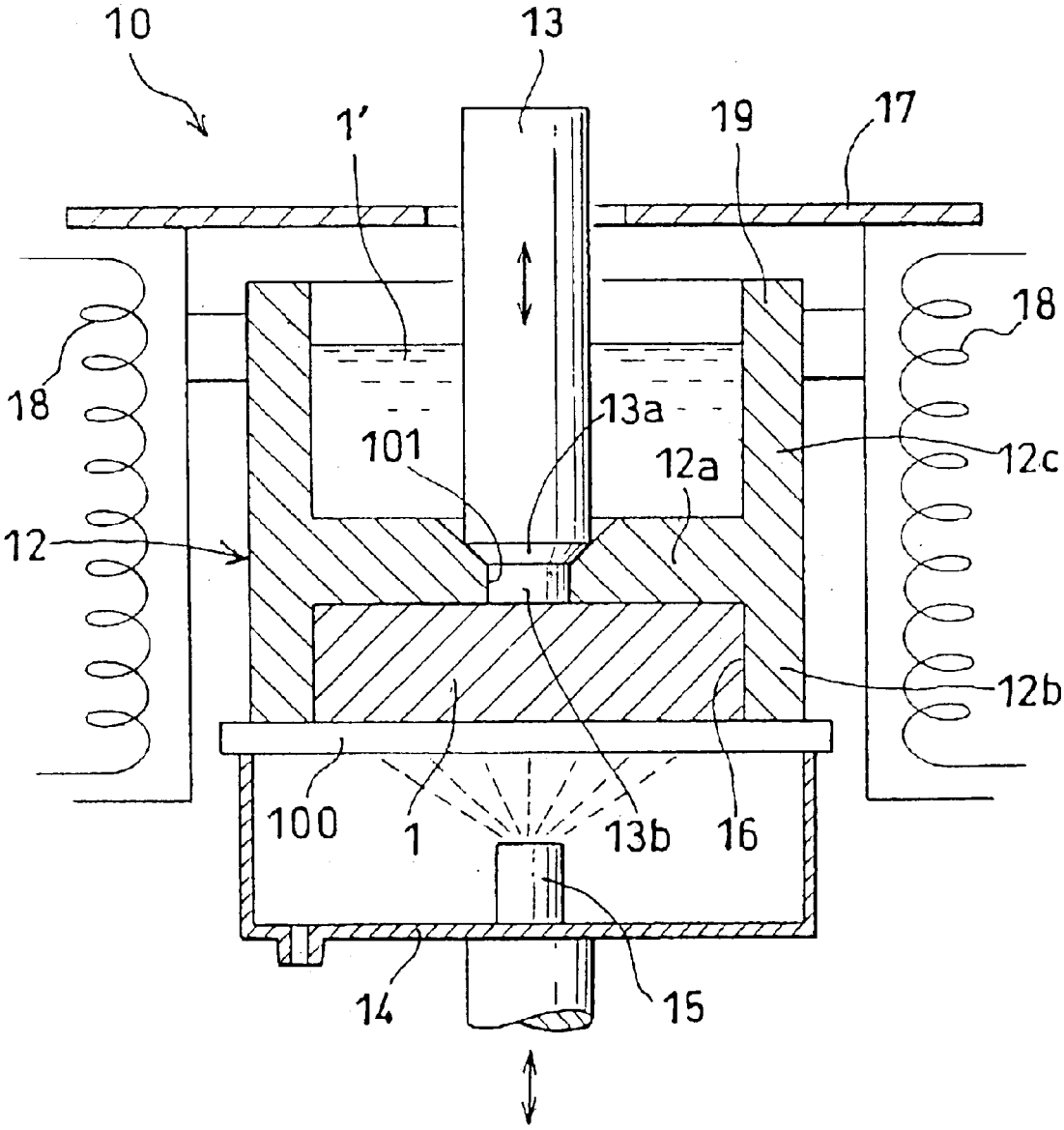
FIG. 1 is a schematic view of a casting apparatus for producing the material for plastic working of the present invention through casting.

FIG. 1 is a schematic view of a casting apparatus for producing a material for plastic working of the present invention through casting.

The casting apparatus illustrated in FIG. 1 is used to produce metal ingots which serve as raw materials to be subjected to plastic working, such as cold forging, hot forging, closed forging, rolling, extrusion or component rolling, or to produce a variety of castings such as blanks having the shapes of final products (i.e., material for plastic working or metal ingot).

Raw materials for producing ingots are typically steel, and preferably are non-ferrous metal species, such as aluminum, zinc and magnesium, and their alloys.

The aluminum alloys to be used as the material of the present invention for plastic working are required to have a composition falling within a range that produces the secondary phase crystal grains.

More specifically, materials with excellent wear resistance are typically aluminum-silicon-based alloys containing silicon (Si) in an amount of 5 to 24 mass % and one or more of not more than 7 mass % of copper (Cu), not more than 2 mass % of magnesium (Mg) not more than 3 mass % of nickel (Ni). Examples thereof include alloys for castings, such as AC2B, AC4C, AC8C and AC9B as specified by JIS standards and A390 as specified by AA standards, and alloys to be subjected to flattening, led by those specified by JIS 4032. Any of these materials may be employed as a raw material for plastic working.

When strength at high temperature is desired, vanadium (V), zirconium (Zr), titanium (Ti), chromium (Cr), manganese (Mn), silver (Ag) or scandium (Sc) is preferably added singly or in combination in an amount of 0.5 mass % or less.

As shown in FIG. 1, the casting apparatus 10 comprises a cooling plate 100, a mold 12 and a stopper 13.

The cooling plate 100 is formed from metal endowed with excellent refractory properties and high thermal conductivity, such as iron (Fe), copper (Cu) or aluminum (Al), or from a refractory material with high thermal conductivity, such as graphite, silicon carbide (SiC) or silicon nitride ($Si_3N_4$).

The cooling plate 100 has a casing 14 and a spray nozzle 15 on its lower side.

The casing 14 has a bottomed, hollow cylindrical shape and is disposed so as to cover the lower surface of the cooling plate 100.

The spray nozzle 15 for jetting cooling water through jet holes provided at the top of the nozzle is attached to the casing 14 such that a top end of the nozzle 15 has a view of the interior of the casing 14, with jet holes facing the lower surface of the cooling plate 100.

The cooling plate 100, casing 14 and spray nozzle 15 are connected via the casing 14 to an elevator-driving unit not shown and, when the elevator-driving unit is driven, can be moved upward and downward as a unit.

The mold 12 is integrally formed of a partition 12*a* having a diameter smaller than that of the cooling plate 100, a side wall 12*b* provided along the periphery of the lower surface of the partition 12*a* and an upper wall 12*c* provided along the periphery of the upper surface of the partition 12*a*.

The mold 12 is fixedly provided in a region above the cooling plate 100, and when the cooling plate 100 moves downward, the bottom of the mold opens, whereas when the cooling plate 100 moves upward, the bottom of the mold is closed to thereby define a mold cavity 16 closed by the partition 12*a*, side wall 12*b* and cooling plate 100.

Material for forming the mold 12 is determined in consideration of relevant conditions, such as the raw material for a cast ingot (raw material to be subjected to plastic working) 1 to be produced, wettability of the mold material with respect to molten metal 1', temperature during use and corrosion resistance. It can be suitably selected from among heat insulating refractory materials containing as a predominant component calcium silicate ($CaSiO_3$), calcium oxide (CaO), silicon dioxide ($SiO_2$), aluminum oxide ($Al_2O_3$) or magnesium oxide (MgO); refractory materials of single-component or multi-components selected from among silicon nitride ($Si_3N_4$), boron nitride (BN)-containing silicon nitride, silicon carbide (SiC), graphite, boron nitride (BN), titanium dioxide ($TiO_2$), zirconium oxide ($ZiO_2$) and aluminum nitride (AlN); and metal species, such as iron and copper.

Although not shown in FIG. 1, the mold 12 preferably has air passages at appropriate positions of the mold 12 so that the air confined in the cavity 16 can be released upon teeming.

The mold 12 has a molten metal inlet 101 at the central position of the partition 12*a*.

While the lower section of the molten metal inlet 101 has, for example, an inner diameter of 12 mm, the upper section has a funnel shape with upwardly increasing inner diameter.

The angle of elevation of the funnel-shaped section is 15° to 75°, preferably 30° to 60°.

The mold 12 employed in the present embodiment is formed of silicon carbide.

The position at which the molten metal inlet 101 is placed is not limited to the center of the partition 12*a*, but may be any position variable depending on the shape and use of the cast ingot 1. For example, when the presence of a mark or trace transcribed from the molten metal inlet 101 on the final product of plastic working is not desired, the position of the inlet can be determined by selecting the portion which will not leave such trace (e.g., a portion which will be removed through, for example, cutting).

The stopper 13 has a cylindrical body, and its lower end portion has a diameter greater than the inner diameter of the lower section of the molten metal inlet 101 but smaller than the inner diameter of the opening of the funnel-shaped portion. A diameter-decreasing portion 13*a* and a fit end 13*b* are provided downward from the lower end portion of the cylindrical body.

The outer diameter of the portion 13*a* gradually decreases downward. The fit end 13*b* also has a cylindrical shape and is formed such that it can be tightly inserted into the lower section of the molten metal inlet 101.

The stopper 13 is movable upward and downward, with its axis coinciding with the center axis of the molten metal inlet 101, and ascends or descends when urged by a driving force transmitted from a stopper-driving unit not shown.

Preferably, the material of the stopper 13 is selected from among heat-insulating refractory materials containing as a predominant component calcium silicate ($CaSiO_3$), calcium oxide (CaO), silicon dioxide ($SiO_2$), aluminum oxide ($Al_2O_3$) or magnesium oxide (MgO) or from among non-metallic materials endowed with excellent refractory/heat-insulating properties and mechanical strength, such as silicon carbide, trisilicon tetranitride and mixtures thereof. It is also possible to employ metallic materials, such as iron and cast steel, which are non-reactive, or only slightly reactive, with the melt 1'.

Reference numeral 17 denotes a lid for covering the upper region of the mold 12, and reference numeral 18 denotes an electric furnace connected with the upper wall 12*c* of the mold 12.

In the production of a cast ingot (material for plastic working) 1 by use of the casting apparatus 10 having the above structure, the elevator-driving unit (not shown) is first operated to move the cooling plate 100 upward to thereby form the mold cavity 16 defined by the mold partition 12*a*, mold side wall 12*b* and cooling plate 100.

Then, the stopper-driving unit is operated to move the stopper 13 downward until the fit end 13*b* of the stopper 13 is fitted in the lower section of the molten metal inlet 101 and the diameter-decreasing portion 13*a* of the stopper 13 abuts the corresponding funnel-defining wall of the molten metal inlet 101.

When the mold has the above configuration, the molten metal inlet 101 is closed with the stopper 13, and thus the mold cavity 16 is isolated from a reservoir 19 defined by the partition 12*a* and upper wall 12*c*.

When the molten metal inlet 101 is closed with the stopper 13, the lower face of the partition 12*a* is flush with the lower face of the fit end 13*b*.

In this connection, in order to facilitate removal of the cast ingot 1 from the mold, the surfaces that define the cavity 16 of the mold 12 are preferably coated with a mold-releasing agent, and in order to prevent chemical reaction with molten metal 1', the stopper 13 is also preferably coated with a mold-releasing agent.

Subsequently, the electric furnace 18 is operated to thereby supply a predetermined amount of molten metal 1' into the reservoir 19.

Operation of the electric furnace 18 is performed for the purpose of not only maintaining the molten metal 1' contained in the reservoir 19 at a predetermined temperature, but also preventing heat absorption through the side wall 12*b* so as to attain an improved effect of unidirectional solidification which will be described hereinbelow.

Thereafter, the stopper-driving unit is operated to thereby translate the stopper 13 upward and remove the fit end 13*b* of the stopper 13 from the lower section of the molten metal inlet 101.

When the mold has the above configuration, the molten metal inlet 101 is open to thereby establish communication between the reservoir 19 and the mold cavity 16, allowing continuous teeming of molten metal 1' contained in the reservoir 19 into the mold cavity 16 through the molten metal inlet 101 so as to completely fill the cavity.

When the stopper 13 is translated upward, the cooling plate 100 is preferably heated to at least 100° C. in advance, because the temperature of the cooling plate 100 lower than 100° C. permits generation of a blow defect, a type of casting defects. Thus, preferably, the cooling plate 100 is heated to a temperature between 100° C. and the temperature of the molten metal 1' inclusive.

Moreover, in order to prevent generation of the blow defect, the cooling plate 100 is preferably coated with a mold-releasing agent in advance.

Coarsening the surface of the cooling plate 100 through shot blasting is also effective for preventing blow defects.

When the cavity 16 has been completely filled with molten metal 1', the stopper 13 is again translated downward, to thereby close the molten metal inlet 101.

Just before completion of teeming, or when the temperature of the cooling plate 100 has arrived at a temperature predetermined after completion of teeming, cooling water is jetted onto the cooling plate 100 through the spray nozzle 15.

A thermocouple has been inserted in the cooling plate 100 at the position at which molten metal arrives last so as to monitor changes in temperature of the cooling plate 100. When cooling water is jetted onto the cooling plate 100, it has been confirmed that molten metal 1' which fills the mold cavity 16 starts to solidify unidirectionally upward from the bottom.

That is, solidification proceeds such that solidification interface (i.e., the interface between a molten metal portion and a solidified portion) gradually moves upward from the cooling plate 100, with unidirectionality of the movement being maintained, preferably without forming a closed region, to thereby attain complete solidification of the molten metal 1'.

When molten metal 1' within the mold cavity 16 has been solidified, the cooling plate 100 is translated downward with respect to the mold 12, and the cast body 1 is released from the mold 12 onto the cooling plate 100.

The cast ingots 1 obtained have a variety of shapes in accordance with the configuration of the mold cavity, and in the present case have parallel upper and lower faces corresponding respectively to the stopper 13 and the cooling plate 100. When the configuration of the cavity 16 is changed, cast ingots 1 of arbitrary shapes can be obtained. For example, the upper and lower faces may not be parallel to each other, and a combination of a flat surface and a curved surface may be employed.

Also, the upper and lower ends of the cavity 16 may have curved planes. Furthermore, three-dimensional profile cast ingots having curved surfaces may be produced.

In this case, although solidification interface does not necessarily assume a horizontal flat plane, unidirectionality of solidification is maintained, preventing formation of a closed region.

In the above-described production of cast ingot 1, solidification interface always proceeds unidirectionally, without forming a closed region, to thereby realize unidirectional solidification. Therefore, the interior of the ingot has excellent quality, being free from defects such as casting cavities, shrinkage cavities, pinholes and oxide inclusion.

Moreover, since the upper space of the mold cavity 16 is closed by the partition 12*a* and the surface of the lowermost end of the stopper 13, the volume of teemed molten metal never changes, eliminating the need for measuring the volume of molten metal to be teemed. In addition, a large curvature is not formed at the meniscus, and thus there is no risk of significant variation in the size and weight of the cast ingot 1.

The present invention will be described in detail with reference to Examples to which it is not limited.

EXAMPLE 1

Figure 2:
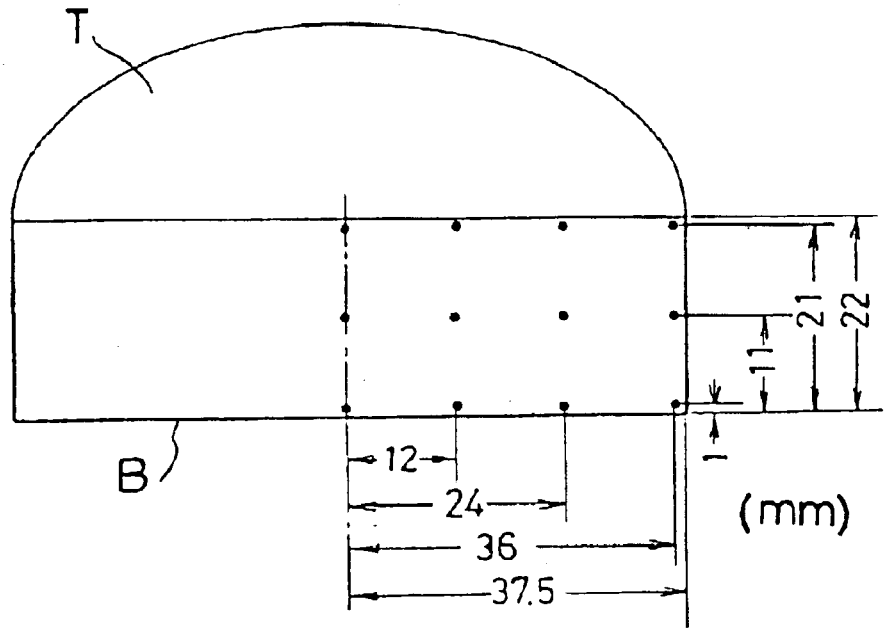
FIG. 2 shows the shape of the ingot cast in Example 1.

By use of a casting apparatus 10 shown in FIG. 1, ingots 75 mm in diameter and 22 mm in thickness as shown in FIG. 2 were produced by casting.

The ingots were produced, under casting conditions shown in Table 2 below, from alloy 1 (JIS 4032 alloy) having a chemical component (mass %) shown in Table 1 below.

TABLE 1

| | Si | Cu | Mg | Ni | Fe | Ti | Sr | Ca | P |
|---|---|---|---|---|---|---|---|---|---|
| Alloy 1 | 13.5 | 1.3 | 0.9 | 1.0 | 0.31 | | | 0.002 | 0.004 |
| Alloy 2 | 9.5 | 3.0 | 0.45 | | 0.18 | | 0.005 | | |
| Alloy 3 | 6.7 | | 0.35 | | 0.21 | 0.12 | | | |
| Alloy 4 | 16.7 | 4.5 | 0.45 | | 0.35 | | | | 0.010 |

TABLE 2

| Items | Note |
|---|---|
| 1. Alloy species | Alloy 1 |
| 2. Temperature of molten metal in reservoir | 720° C. |
| 3. Material of mold and reservoir | SiC |
| 4. Difference between levels of molten metal in reservoir and mold cavity just before stopper is closed | 150 mm |
| 5. Temperature of cooling plate before teeming | 100° C. |
| 6. Flow rate of cooling water | 5 L/min |
| 7. Diameter of molten metal inlet | 12 mm |
| 8. Atmospheric temperature within electric furnace | 750° C. |
| 9. Temperature of partition and side wall | 680° C. |
| 10. Casting procedure | |
| 1) Teeming | Stopper closed in 10 sec. |
| 2) Cooling plate | Water cooling initiated at 500° C. |
| 3) Cooling plate | Water cooling terminated at 100° C. |
| 4) Cooling plate | Cooling plate descending at 150° C. |
| 5) Removal of material | Spontaneous falling |

The cast ingots were homogenized at 505° C. for six hours and aged under the specific conditions shown in Table 3 below.

TABLE 3

| | |
|---|---|
| Solid solution treatment temperature | 505° C. |
| Treatment time | 2 hours |
| Tempering temperature (Aging temperature) | 180° C. |
| Treatment time (Aging time) | 8 hours |

Method of Measuring Cooling Rate

Twelve thermocouples (represented by black dots in FIG. 2) were set in position for measuring the cooling rate of metal material during casting, and molten metal was then added. The change in temperature during solidification was recorded at each position, and the cooling rate at the position was calculated.

The thermocouples were K-type sheath couples 0.5 mm in diameter and were three-dimensionally located in the mold cavity such that heat measurement was not affected.

On the basis of the recorded temperature changes, the difference at each position between the liquidus temperature and the solidus temperature was divided by the difference between the time at which liquid phase appeared and that at which solid phase appeared to thereby obtain the cooling rate C (°C./sec) at the position.

An average solidification rate S (mm/sec) between two arbitrary points was obtained by dividing the distance between the two points in the solidification direction of the ingot by the difference between the time at which the solidus temperature was attained at one point and the corresponding time at the other point.

Table 4 below shows the results of cooling rate measurement.

TABLE 4

| | | Distance in radial direction from the center (mm) | | | |
|---|---|---|---|---|---|
| | | 0 | 12 | 24 | 36 |
| Distance in thickness direction from the bottom (mm) | 21 | 14.86 | 3.58 | 3.46 | 3.43 |
| | 11 | 3.42 | 3.56 | 3.71 | 3.86 |
| | 1 | 4.52 | 4.68 | 5.36 | 6.55 |

With regard to the cooling rates measured at locations in the radial direction from the center, each location including three measurement points arranged in the thickness direction, the cooling rates measured at positions 1 mm above the bottom face (cooled face: B surface) were the highest and gradually decreased as the point approached the top surface, except for the case of the cooling rate measured at the point directly beneath the molten metal inlet.

As shown in Table 5 below, the ratio of each cooling rate as measured at a point 1 mm directly beneath the top surface (T surface) (i.e., 21 mm above the bottom face (B surface)) to the cooling rate as measured at a point 1 mm above the bottom face (B surface) was equal to or lower than 0.76 except for the ratio measured at the point directly beneath the molten metal inlet.

A conceivable reason for the considerably large cooling rate measured at the point directly beneath the molten metal inlet would be as follows. During casting, the stopper opens the molten metal inlet to thereby allow molten metal to be teemed into the mold cavity, and in addition, in order to compensate for solidification shrinkage of the cast ingot, additional molten metal was replenished by opening the stopper (i.e., the riser effect). Thus, the heat supplied from the molten metal contained in the reservoir and latent heat generated through solidification of molten metal retarded solidification.

When the stopper closed the molten metal inlet, heat supply was immediately stopped to thereby induce sudden solidification.

TABLE 5

| | | Distance in radial direction from the center (mm) | | | |
|---|---|---|---|---|---|
| | | 0 | 12 | 24 | 36 |
| Distance in thickness direction from the bottom (mm) | 21 | 3.29 | 0.76 | 0.65 | 0.52 |
| | 11 | 0.76 | 0.76 | 0.69 | 0.59 |
| | 1 | 1.00 | 1.00 | 1.00 | 1.00 |

Table 6 below shows the results of solidification rate measurement.

TABLE 6

| | | Distance in radial direction from the center (mm) | | | |
|---|---|---|---|---|---|
| | | 0 | 12 | 24 | 36 |
| Range of measurement on solidification rate (mm) | 11–21 | 0.44 | 1.94 | 4.38 | 4.38 |
| | 1–11 | 2.50 | 2.92 | 3.50 | 3.80 |

Within the range of the center to the point 12 mm from the center in a radial direction, the solidification rates measured on the top surface (T surface) side were lower than those measured on the bottom face (B surface) side.

As was also mentioned above in connection with the results of cooling rate measurement, lowering of the solidification rate would be believed to be caused by heat supply from the reservoir to a portion in the vicinity of the molten metal inlet during casting.

In contrast, within the range of the point 24 mm from the center to the periphery in a radial direction, the solidification rates measured on the top surface (T surface) side were higher than those measured on the bottom face (B surface) side.

A conceivable reason for the increase in solidification rate would be as follows. At the start of casting, the solidification rates of molten metal on the bottom face side decreased because of heat retained in the molten metal in the mold cavity and latent heat generated through solidification. However, by the time when the molten metal on the top surface (T surface) side began to solidify, the molten metal near the bottom face cooled and retained less heat.

REFERENTIAL EXAMPLES

Figure 3:
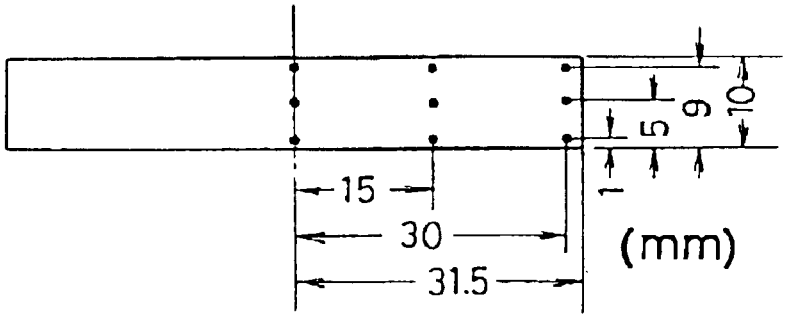
FIG. 3 shows the shape of the ingot cast in Referential Example.
Figure 4:
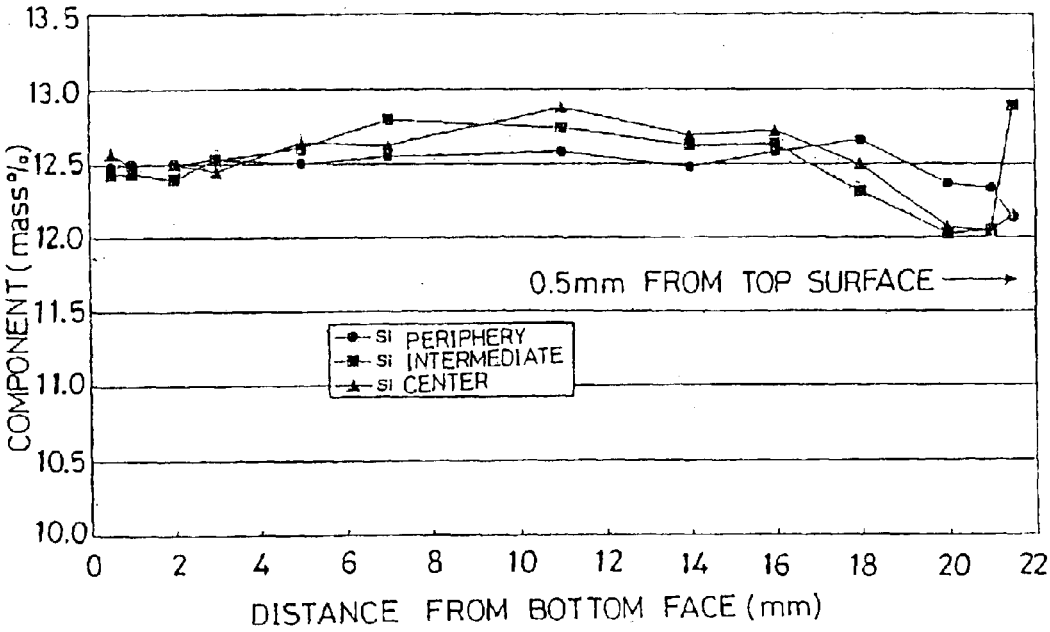
FIG. 4 shows changes in silicon component from the bottom to the top of the ingot cast in Example 1.
Figure 5:
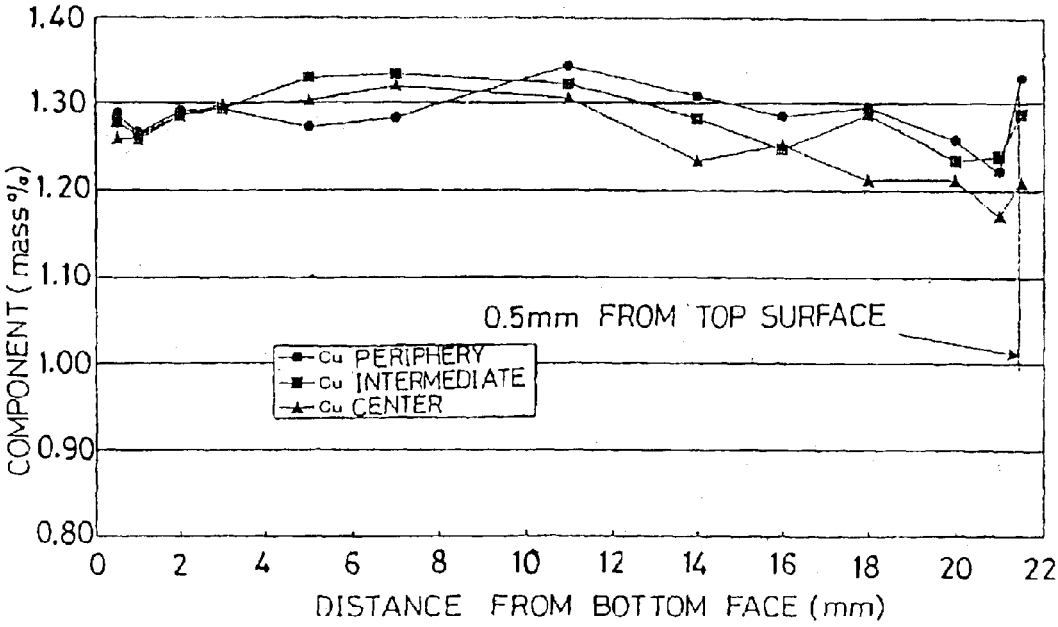
FIG. 5 shows changes in copper component from the bottom to the top of the ingot cast in Example 1.
Figure 6:
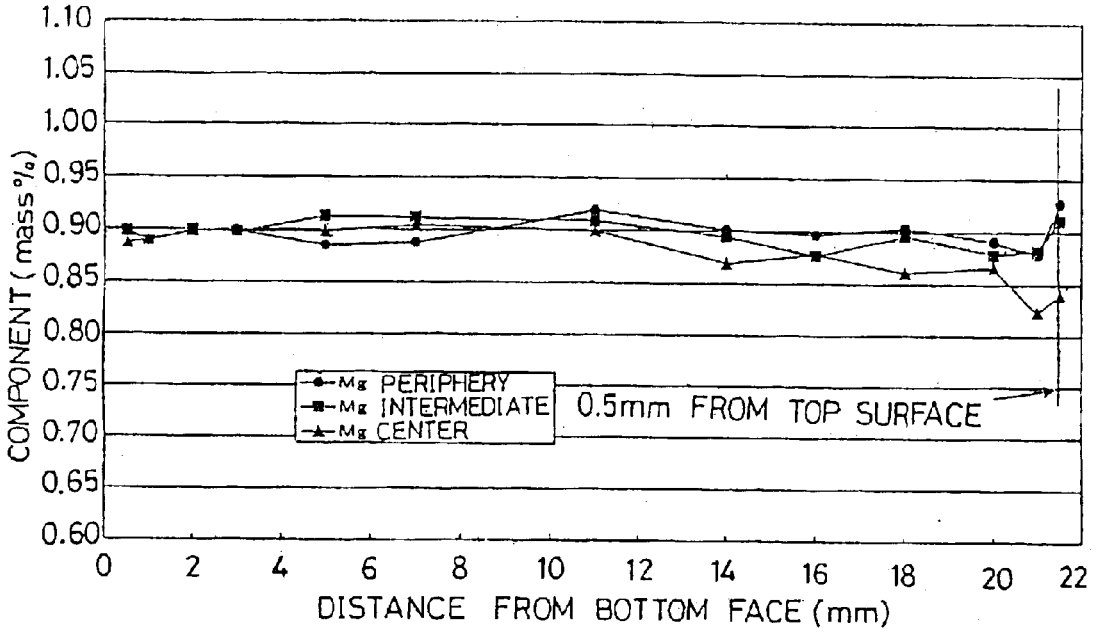
FIG. 6 shows changes in magnesium component from the bottom to the top of the ingot cast in Example 1.
Figure 7:
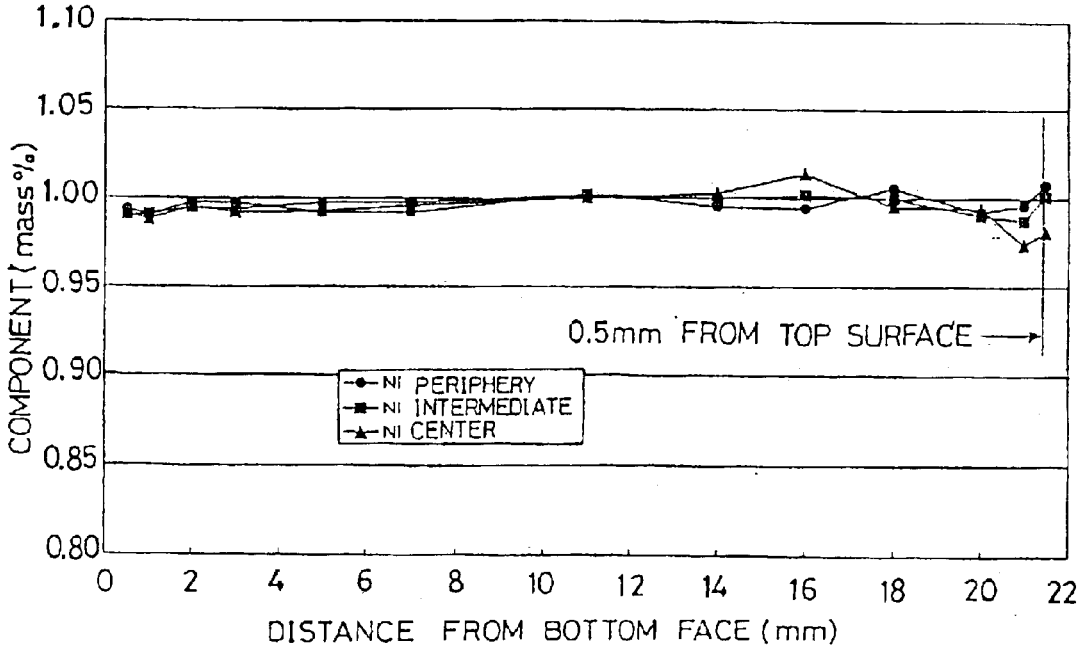
FIG. 7 shows changes in nickel component from the bottom to the top of the ingot cast in Example 1.

By use of the casting apparatus 10 shown in FIG. 1, ingots 63 mm in diameter and 10 mm in thickness as shown in FIG. 3 were produced by casting.

The ingots were produced from Al—Cu-based alloy (JIS 2218 alloy).

In the mold cavity, nine thermocouples (represented by black dots in FIG. 3) were set in position for measuring the cooling rate of metal material during casting.

The cooling rates thus measured are shown in Table 7 below, which is analogous to Table 4 above, and Table 8 below, which is analogous to Table 5 above, shows the normalized cooling rates.

TABLE 7

| | | Distance in radial direction from the center (mm) | | |
|---|---|---|---|---|
| | | 0 | 15 | 30 |
| Distance in thickness direction from the bottom (mm) | 9 | 36.00 | 21.06 | 30.74 |
| | 5 | 24.36 | 26.40 | 38.22 |
| | 1 | 23.34 | 30.56 | 40.74 |

TABLE 8

| | | Distance in radial direction from the center (mm) | | |
|---|---|---|---|---|
| | | 0 | 15 | 30 |
| Distance in thickness direction from the bottom (mm) | 9 | 1.54 | 0.69 | 0.75 |
| | 5 | 1.04 | 0.86 | 0.94 |
| | 1 | 1.00 | 1.00 | 1.00 |

In the case of JIS 2218 alloy, the cooling rate was generally higher by one cipher than that of the alloy of Example 1, but the cooling rate profile was similar to that obtained in Example 1. Briefly, similar to the case of Example 1, the cooling rate decreased along the advancement direction of solidification, except for the case of the cooling rate measured at the point directly beneath the molten metal inlet.

As described above, the measurement results of the cooling rate and solidification rate indicate that the solidification interface advances from the cooling plate toward the top surface (T surface) including the molten metal inlet, without closing the solidification interface, although variation in cooling rate and solidification rate depending on the points of measurement is observed.

COMPARATIVE EXAMPLE 1

Using a molten metal identical to that of Example 1 and a continuous casting method as disclosed in JP-B SHO 54-42847, a continuously cast rod was produced under the casting conditions shown in Table 9 below.

TABLE 9

| Items | Note |
|---|---|
| 1) Alloy species | Alloy 1 |
| 2) Header overhang length | 10 mm |
| 3) Temperature of molten metal | 740° C. |
| 4) Flow rate of cooling water | 3 L/min |
| 5) Casting speed | 200 mm/min |
| 6) Lubricant | Castor oil |
| 7) Flow rate of lubricant | 1 L/min |
| 8) Type of gas | Air |
| 9) Flow rate of gas | 0.2 L/min |

The rod was cut into pieces 22 mm in thickness. The cut pieces were homogenized under the same conditions as in Example 1, i.e. at 505° C. for six hours, and aged under the specific conditions shown in Table 3 above.

The thus-cast ingots of Example 1 and Comparative Example 1 were cut to thereby produce test pieces for observation of metallographic structure, hardness measurement and wear resistance measurement.

In the case of Example 1, the test pieces were prepared by cutting the cast ingots at a position 20 mm inside their periphery in a direction identical with the solidification direction. In the case of Comparative Example 1, the test pieces were prepared by cutting the cast ingots at a position 20 mm inside the cast surface in a direction parallel to the solidification direction.

Observation of Metallographic Structure

In Example 1, the eutectic silicon grain size, primary silicon crystal grain size and percent area occupancy thereof were measured at five points located 20 mm inside the periphery (17.5 mm from the center) of each ingot, specifically, at 1 mm, 6 mm, 11 mm, 16 mm and 21 mm from the bottom face (B surface) toward the top surface (T surface).

Eutectic silicon grains and primary silicon crystal grains are types of secondary phase crystal grains.

Each sample to be observed was finish-polished, and metallographic structure thereof was observed by means of an image analysis processor equipped with a microscope.

As the image analysis processor, "COSMOZONE R500" (product of Nikon Co., Ltd.) was employed.

The magnification of the microscope was 400 or 800 when measuring eutectic silicon grain size. Primary silicon crystal grain size was measured at a magnification of 200.

Two types of grain sizes were measured. One of them is the circle-equivalent diameter (HEYWOOD diameter), which is obtained by reducing the average cross-section of grains found in the observed surface to the area of a circle and representing the size by the diameter of the circle. The other grain size is the maximum chord length (MAXLNG: maximum length), which is the maximum grain width. The percent area occupancy of each type of grains was measured, and the measured values were summed to thereby obtain the percent area occupancy of total silicon grains.

Table 10 below shows measurements in terms of HEYWOOD diameter and average MAXLNG ($\mu$m) of eutectic silicon grains at various points in the ingot of Example 1.

Table 11 below shows measurements in terms of HEYWOOD diameter and average MAXLNG ($\mu$m) of primary silicon crystal grains at various points in the ingot of Example 1.

TABLE 10

| | Distance from the bottom (mm) | | | | |
|---|---|---|---|---|---|
| | 1 | 6 | 11 | 16 | 21 |
| HEYWOOD diameter | 2.45 | 3.06 | 4.15 | 5.10 | 5.85 |
| MAXLNG | 3.38 | 4.97 | 7.68 | 9.26 | 11.47 |

TABLE 11

| | Distance from the bottom (mm) | | | | |
|---|---|---|---|---|---|
| | 1 | 6 | 11 | 16 | 21 |
| HEYWOOD diameter | 7.20 | 9.12 | 10.96 | 11.00 | 12.35 |
| MAXLNG | 9.60 | 12.88 | 14.98 | 15.54 | 18.15 |

The eutectic silicon grains and primary silicon crystal grains became coarser, in a linear manner, from the bottom face (B surface) to the top surface (T surface) (in the thickness direction).

From the bottom face (B surface) to the level 6 mm from the bottom, virtually no primary silicon crystal grain was generated, since the molten metal was rapidly cooled to solidify.

A conceivable reason for coarsening of eutectic silicon and primary silicon crystals at the top surface (T surface) would be that the cooling rate on the top surface (T surface) side was lower than that on the bottom face (B surface) to thereby attain slow cooling conditions.

Table 12 below shows the percent area occupancy (%) of eutectic silicon, that of primary silicon crystals and that of the sum of both types of silicon at the points in the ingot of Example 1.

TABLE 12

| | Distance from the bottom (mm) | | | | |
|---|---|---|---|---|---|
| | 1 | 6 | 11 | 16 | 21 |
| Eutectic Si | 11.5 | 11.3 | 10.6 | 9.5 | 8.5 |
| Primary Si | 0.0 | 0.2 | 1.8 | 2.4 | 3.9 |
| Total | 11.5 | 11.5 | 12.4 | 11.9 | 12.4 |

Values of the percent area occupancy of the sum of both types of silicon measured at the points in the thickness direction were almost the same. However, the percent area occupancy of eutectic silicon gradually decreased toward the advancement of solidification (from the bottom face (B surface) side to the top surface (T surface) side), whereas the percent area occupancy of primary silicon crystals gradually increased toward the advancement of solidification (from the bottom face (B surface) side to the top surface (T surface) side)

This was because growth of primary silicon crystals predominates growth of eutectic silicon on the top surface (T surface) side.

The above measurements were reduced to the normalized values with respect to the values measured at the bottom face (B surface) for re-evaluation. Table 13 below shows the normalized grain size and maximum length of eutectic silicon, and Table 14 below shows the normalized grain size and maximum length of primary silicon crystals. Table 15 below shows the normalized percent area occupancy of the sum of both types of silicon.

TABLE 13

| | Distance from the bottom (mm) | | | | |
|---|---|---|---|---|---|
| | 1 | 6 | 11 | 16 | 21 |
| Average HEYWOOD diameter | 1.0 | 1.2 | 1.7 | 2.1 | 2.4 |
| Average MAXLNG | 1.0 | 1.5 | 2.3 | 2.7 | 3.4 |

TABLE 14

| | Distance from the bottom (mm) | | | | |
|---|---|---|---|---|---|
| | 1 | 6 | 11 | 16 | 21 |
| Average HEYWOOD diameter | 1.0 | 1.3 | 1.5 | 1.5 | 1.7 |
| Average MAXLNG | 1.0 | 1.3 | 1.6 | 1.6 | 1.9 |

TABLE 15

| | Distance from the bottom (mm) | | | | |
|---|---|---|---|---|---|
| | 1 | 6 | 11 | 16 | 21 |
| Eutectic Si + Primary Si | 1.00 | 1.00 | 1.08 | 1.03 | 1.07 |

The HEYWOOD diameter and MAXLNG of eutectic silicon grains measured on the top surface (T surface) side were 2.4 times and 3.4 times, respectively, those measured on the bottom face (B surface) side. The HEYWOOD diameter and MAXLNG of primary silicon crystals grains measured on the top surface (T surface) side were 1.7 times and 1.9 times, respectively, those measured on the bottom face (B surface) side.

A blank obtained from the ingot of Comparative Example 1 showed no difference between one surface and another surface in terms of the size of silicon grains and size distribution. Specifically, the HEYWOOD diameter and MAXLNG of eutectic silicon measured at a position inside the cast surface were 2.13 μm and 2.94 μm, respectively. The HEYWOOD diameter and MAXLNG of primary silicon crystals measured at the position were 9.48 μm and 12.62 μm, respectively. The percent area occupancies of the eutectic silicon, the primary silicon crystals and the sum of both types of silicon measured at the position were 12.37%, 0.31% and 12.68%, respectively.

The average grain size and percent area occupancy of eutectic silicon grains are approximately equal to those measured at the position 1 mm above the bottom face (B surface) in Example 1. The average grain size and percent area occupancy of primary silicon crystal grains are approximately equal to those measured at the position 6 mm above the bottom face (B surface) in Example 1.

The percent area occupancy (%) of the sum of both types of silicon is approximately equal to that of the ingot of Example 1.

Tables 16 and 17 below show the grain size (HEYWOOD diameter) of eutectic silicon grains and its associated percentage in the ingots of Example 1 and Comparative Example 1, respectively and the average grain size thereof.

TABLE 16 (1/2)

| | Grain size (μm) | | | | | | | | | | |
|---|---|---|---|---|---|---|---|---|---|---|---|
| Position of measurement | 0 | 0.8 | 1.6 | 2.4 | 3.2 | 4 | 4.8 | 5.6 | 6.4 | 7.2 | 8 |
| 21 mm from B surface | 0 | 3.8 | 7.6 | 11.4 | 14.5 | 17.5 | 9.5 | 83 | 6.8 | 5.3 | 3.8 |
| 16 mm from B surface | 0 | 4.7 | 9.4 | 14.1 | 17.4 | 20.6 | 15.4 | 10.5 | 9.3 | 6 | 3.5 |
| 11 mm from B surface | 0 | 5.8 | 11.6 | 17.4 | 21.5 | 16.4 | 10.1 | 7.5 | 4.9 | 3.5 | 1.9 |
| 6 mm from B surface | 0 | 10.8 | 26.6 | 22 | 21.5 | 12 | 8.2 | 4.4 | 0.6 | 0.6 | 0 |
| 1 mm from B surface | 0 | 15.5 | 33.7 | 29.1 | 11.6 | 8.1 | 1.6 | 0 | 0.4 | 0 | 0 |

TABLE 16 (2/2)

| | Grain size (μm) | | | | | | | | | | | |
|---|---|---|---|---|---|---|---|---|---|---|---|---|
| Position of measurement | 8.8 | 9.6 | 10.4 | 11.2 | 12 | 12.8 | 13.6 | 14.4 | 15.2 | 16 | 16.8 | Av. |
| 21 mm from B surface | 3.4 | 2.8 | 2.2 | 1.6 | 1 | 0.65 | 0.52 | 0.39 | 0.26 | 0.13 | 0 | 5.85 |
| 16 mm from B surface | 2.2 | 1.4 | 1 | 0.8 | 0.4 | 0 | 0.1 | 0.1 | 0 | 0 | 0 | 5.10 |
| 11 mm from B surface | 1.5 | 0.9 | 0.4 | 0 | 0 | 0 | 0 | 0 | 0 | 0 | 0 | 4.15 |
| 6 mm from B surface | 0 | 0 | 0 | 0 | 0 | 0 | 0 | 0 | 0 | 0 | 0 | 3.06 |
| 1 mm from B surface | 0 | 0 | 0 | 0 | 0 | 0 | 0 | 0 | 0 | 0 | 0 | 2.45 |

TABLE 17 (1/2)

| | Grain size (μm) | | | | | | | | | | |
|---|---|---|---|---|---|---|---|---|---|---|---|
| Position of measurement | 0 | 0.8 | 1.6 | 2.4 | 3.2 | 4 | 4.8 | 5.6 | 6.4 | 7.2 | 8 |
| 20 mm from cast surface | 0 | 5.4 | 39.1 | 25.5 | 18.2 | 5.6 | 2.1 | 0.2 | 0 | 0 | 0 |

TABLE 17 (2/2)

| | Grain size (μm) | | | | | | | | | | | |
|---|---|---|---|---|---|---|---|---|---|---|---|---|
| Position of measurement | 8.8 | 9.6 | 10.4 | 11.2 | 12 | 12.8 | 13.6 | 14.4 | 15.2 | 16 | 16.8 | Av. |
| 20 mm from cast surface | 0 | 0 | 0 | 0 | 0 | 0 | 0 | 0 | 0 | 0 | 0 | 2.13 |

Table 18 below shows the percentage (%) of eutectic silicon grains having a grain size of 4 μm or less in the ingot of Example 1. The percentage of eutectic silicon grains having a grain size of 4 μm or less in the ingot of Comparative Example 1 was 87.7%.

TABLE 18

| Distance from the bottom (mm) | Percentage % |
|---|---|
| 1 | 98.0 |
| 6 | 92.9 |
| 11 | 72.7 |
| 16 | 66.2 |
| 21 | 54.8 |

In the ingot of Example 1, the average grain size of eutectic silicon measured at the position 1 mm above the bottom face (B surface) was 2.45 μm and the percentage of grains having a grain size of 4 μm or less was 98%, indicating the presence of a number of micrograms. In contrast, the average grain size measured at the position 21 mm above the bottom face (B surface) was 5.85 μm and the percentage of grains having a grain size of 4 μm or less was as low as 54.8%, indicating the presence of a number of coarse eutectic silicon grains on the top surface (T surface) side.

In the ingot of Comparative Example 1, the average grain size eutectic silicon was 2.13 μm and the percentage of grains having a grain size of 4 μm or less was 87.7%, which was near the grain size distribution in the ingot of Example 1 measured at the position 6 mm above the bottom face (B surface).

Example 1 of the present invention shows that the average grain size and/or average length of secondary phase crystal grains contained in the ingot cast in the casting apparatus increase from the cooling face side toward the side opposite the cooling face side.

Observation of Metallographic Structure (DAS: Dendrite Arm Spacing)

DAS of the ingot of Example 1 was measured at three positions in the thickness direction, namely, at the center of the ingot, the position halfway between the center and the periphery and the position near the periphery.

DAS of the ingot of Comparative Example 1 was measured in a similar manner, but only at the center position, by virtue of metallographic structural homogeneity of the ingot.

DAS was measured in accordance with "Procedure of dendrite arm spacing measurement" described in "*Light Metal*, Vol. 38, No. 1, p. 45 (1988)", published by the Japan Institute of Light Metals.

Table 19 below shows the results of DAS measurement (μm) of the ingot obtained in Example 1, and Table 20 below shows normalized DAS values with respect to those measured 1 mm above the bottom face (B surface) at the intermediate location in the radial direction.

TABLE 19 (1/2)

| | Distance from the bottom | | | | | | | | | |
|---|---|---|---|---|---|---|---|---|---|---|
| | 1 | 2 | 3 | 4 | 5 | 6 | 7 | 8 | 9 | 10 |
| Center | 15.3 | | 17.3 | | | | | | | 21.7 |
| Intermediate | 15.0 | | 20.4 | | | | | | | 22.0 |
| Periphery | 15.5 | | 16.8 | | | | | | | 21.6 |

TABLE 19 (2/2)

| | Distance from the bottom (mm) | | | | | | | | | | |
|---|---|---|---|---|---|---|---|---|---|---|---|
| | 11 | 12 | 13 | 14 | 15 | 16 | 17 | 18 | 19 | 20 | 21 |
| Center | | | 22.7 | | | | | 18.5 | 19.6 | 17.5 | 16.5 |
| Intermediate | | | 27.4 | | | | | 21.1 | 17.7 | 21.5 | 21.3 |
| Periphery | | | 24.9 | | | | | 23.5 | 22.7 | 22.7 | 28.2 |

TABLE 20 (1/2)

| | Distance from the bottom (mm) | | | | | | | | | |
|---|---|---|---|---|---|---|---|---|---|---|
| | 1 | 2 | 3 | 4 | 5 | 6 | 7 | 8 | 9 | 10 |
| Center | 1.0 | | 1.2 | | | | | | | 1.4 |

TABLE 20 (1/2)-continued

| | | | | | | | | | | |
|---|---|---|---|---|---|---|---|---|---|---|
| Intermediate | 1.0 | | 1.4 | | | | | | | 1.5 |
| Periphery | 1.0 | | 1.1 | | | | | | | 1.4 |

TABLE 20 (2/2)

| | Distance from the bottom (mm) | | | | | | | | | | |
|---|---|---|---|---|---|---|---|---|---|---|---|
| | 11 | 12 | 13 | 14 | 15 | 16 | 17 | 18 | 19 | 20 | 21 |
| Center | | | 1.5 | | | | | 1.2 | 1.3 | 1.2 | 1.1 |
| Intermediate | | | 1.8 | | | | | 1.4 | 1.2 | 1.4 | 1.4 |
| Periphery | | | 1.7 | | | | | 1.6 | 1.5 | 1.5 | 1.9 |

At all locations in the radial direction, the DAS values gradually increased as the measurement points approached a core portion of the ingot from the bottom face (B surface). In the case of the points at the center in the radial direction, the values decreased as the points approached the top surface (T surface). However, the decreased value was 1.1 times that measured at the bottom face (B surface) and was not lower than that measured at the bottom face (B surface).

At the intermediate location in the radial direction, a similar type of change in DAS was observed, but the decrease in the vicinity of the top surface (T surface) was slight.

However, when DAS values are normalized with respect to those measured at the center of the bottom face (B surface) in the radial direction, the DAS values were equal to or greater than 1, regardless of the position of measurement.

The DAS value of Comparative Example 1 was 17.2 μm that was substantially equivalent to that measured at the point 3 mm above the bottom face (B surface) in Example 1.

Investigation of the Chemical Component Distribution in an Ingot

The chemical component distribution in the thickness direction of the ingot of Example 1 was investigated using an emission spectral analyzer (product of Shimadzu Corporation), with measurement points at three locations in the ingot, namely at the center, the intermediate location between the center and the periphery and a location in the vicinity of the periphery, each location including a plurality of measurement points arranged in the thickness direction.

The target chemical elements for measurement were those undergoing eutectic reaction, specifically silicon (Si), copper (Cu), magnesium (Mg) and nickel (Ni). A surface of the ingot was cut from the bottom face (B surface) or the top surface (T surface) to the depth for measurement, and the thus-cut ingot was subjected to analysis by the emission spectral analyzer.

FIGS. 4, 5, 6 and 7 show the distribution profile, in the thickness direction of the ingot obtained in Example 1, of silicon (Si), copper (Cu), magnesium (Mg) and nickel (Ni), respectively.

Example 1 of the present invention showed that the concentration of at least one element added to the ingot metal gradually increased from the points on the cooling face side to those on the side opposite the cooling face side.

In each case, the element concentration increased as the measurement points moved away from a position in the vicinity the bottom face (B surface), and thereafter it decreased as the points approached the top surface (T surface). Finally, it became lower than that measured at a position in the vicinity of the bottom face (B surface).

Particularly, the decrease in concentration is great at the center of the ingot, whereas that at the periphery is small as compared with that at the center of the ingot.

Measurement of Hardness

Hardness of a portion of the test piece that underwent the below-described friction-wear test was measured by means of a Rockwell hardness tester (B-scale) (HRB).

Friction-Wear Test

Friction-wear test of an ingot was performed by use of a test apparatus (pin-on-disk type) and under the conditions shown in Table 21 below. Wear resistance of the top surface (T surface). side and that of the bottom face (B surface) side were evaluated.

TABLE 21

| Items | Details |
|---|---|
| 1) Test apparatus | Wear tester Model TRI-S500 (Takachiho Seiki) |
| 2) Test method | Pin-on-disc |
| 3) Disc material | FC230 |
| 4) Lubricant | Clean SJ-GF2 at 80° C. (by Castle Oil Corporation) |
| 5) Load applied | 5 kgf |
| 6) Sliding rate | 0.25 m/sec |
| 7) Sliding time | 60 minutes |
| 8) Shape of pin | 7.9 mm in diameter and 20 mm in height |

A test piece was obtained through mechanical cutting from a position the same as that of the test piece which underwent observation of metallographic structure (20 mm from the periphery) to thereby prepare a columnar (pin-shaped) test piece (dimensions shown in Table 21 above) including an axis parallel to the solidification direction. The test piece was cut such that the surface 1 mm beneath the top surface (T surface) (i.e., 21 mm above the bottom (B surface)) and the surface 1 mm above the bottom face (B surface) were developed to thereby serve as the friction test surfaces.

The amount of wear (decrease in pin length) caused by friction at each surface was measured (i.e., the greater the amount of wear, the poorer the wear resistance).

Table 22 below shows the hardness and amount of wear of the pin of Example 1. The hardness and amount of wear of the pin of Comparative Example 1 were, respectively, 73.8 HRB and 68 μm.

TABLE 22

| Position of measurement | Hardness (HRB) | Amount of wear of the pin (μm) |
|---|---|---|
| 1 mm below the to surface | 73.2 | 23 |
| 1 mm above the bottom surface | 74.3 | 76 |

The hardness measured at positions in the thickness direction of the piece of Example 1 and that of the piece of Comparative Example 1 were nearly equal to one another.

In the case of Example 1, segregation of copper and magnesium, which contributes to hardness of material, was of a level too low to directly affect the hardness.

The amount of wear of the pin of Comparative Example 1 was slightly less than that of the pin of Example 1 at the bottom face (B surface). A conceivable reason would be that primary silicon crystals were precipitated in a small amount in the pin of Comparative Example 1, leading to enhancement in wear resistance, even though the two pins were nearly equal in eutectic silicon grain size.

In the case of Example 1, the amount of wear at the top surface (T surface) of the pin was 23 μm, which was less than ⅓ the amount of wear at the bottom face (B surface), thus indicating excellent wear resistance.

It was conceived that such excellent wear resistance was attained by the fact that both eutectic silicon grain size and primary silicon crystal grain size were greater at the top surface (T surface) as shown in the results of silicon grain size measurement.

Seizure Resistance Test

A seizure resistance test was performed under the conditions shown in Table 23 below.

TABLE 23

| Items | Details |
|---|---|
| 1) Test apparatus | Wear tester Model TRI-S500 (Takachiho Seiki) |
| 2) Test method | Pin-on-disc |
| 3) Disc material | FC230 |
| 4) Lubricating oil | No lubrication |
| 5) Sliding rate | 4.4 m/sec |
| 6) Shape of pin | 7.9 mm in diameter and 20 mm in height |
| 7) Test conditions | Wear test was performed for 2 minutes under an initial load of 5 kgf. The test was continued for a further 2 minutes under an extra load of 5 kgf. The above procedure was repeated while the torque exerted on the pin was measured. The test was terminated when an abnormal measurement is obtained. The load as measured at the termination of the test is taken as the maximum seizure load. |

The seizure resistance was evaluated to be more excellent as the seizure load increased. In the event of equal seizure load measurements, the seizure resistance of a test piece that showed a longer time to generate abnormal load was evaluated to be more excellent.

The imposed load at completion of the test was employed as the maximum seizure load.

Table 24 below shows the results of measurement of the seizure time and seizure load for the test piece of Example 1, and Table 25 below shows the results of measurement of the seizure time and seizure load for the test piece of Comparative Example 1.

TABLE 24

| Position of measurement | Hardness (HRB) | Seizure load (kgf) | Seizure time (min) |
|---|---|---|---|
| 1 mm below the top surface | 73.2 | 15 | 5.7 |
| 1 mm above the bottom surface | 74.3 | 10 | 3.2 |

TABLE 25

| Position of measurement | Hardness (HRB) | Seizure load (kgf) | Seizure time (min) |
|---|---|---|---|
| — | 73.8 | 10 | 3.8 |

The bottom face (B surface) of the test piece of Example 1 and the test piece of Comparative Example 1, which assumed similar metallographic structures, showed approximately equal seizure load values. However, the seizure time was longer in the case of Comparative Example 1, indicating excellent seizure resistance.

However, the top surface (T surface) of the test piece of Example 1 showed a seizure load as high as 15 kgf and a seizure time of 5.7 minutes, which assured approximately double the seizure time of the bottom face (B surface).

It would also be conceived that this was caused by the corresponding metallographic structure.

Machinability Test

When a material to be plastically deformed is subjected to mechanical working, particularly machining, manageability of cut dust is an important issue.

Accordingly, observation was made on the cut dust produced at the top surface (T surface), intermediate surface and bottom face (B surface) of the ingot (material for plastic working) of Example 1 where the silicon grain size was measured. The cut dust from the respective portions was compared in terms of shape of dust particles.

The machinability test was performed in a wet manner by use of a lathe under the cutting conditions shown in Table 26 below.

TABLE 26

| | |
|---|---|
| 1. Turning tool type | Compax tool (Nose radius R2 mm) |
| 2. Revolution | 600 rpm |
| 3. Feed | 0.5 mm/rev |
| 4. Cut depth | 0.2 mm |
| 5. Position of Cut-dust evaluation | Sample radius R24 mm |

The material of Comparative Example 1 was used as a comparative test material.

The test materials were homogenized at 505° C. for six hours and aged under the specific conditions shown in Table 3 above.

Figure 8:
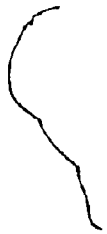
FIG. 8(*a*) shows the shapes of cut dust in Example 1.
Figure 8:
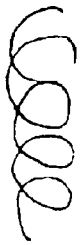
Figure 8:
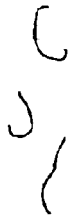
Figure 8:
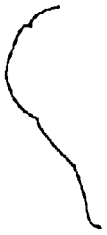

FIG. 8(*a*) shows the test results for the material of Example 1, and FIG. 8(*b*) shows the test results for the material of Comparative Example 1.

In the case of Example 1, the shape of cut dust was categorized into three types, specifically strip, spiral and small fragments.

The cut dust shape observed at the portion 21 mm above the bottom face (B surface) assumed small fragments.

This type of cut dust exhibits most favorable manageability, and is not entangled with a turning tool and raises no problem during management of the cut dust in the lathe.

The cut dust shape observed at the intermediate surface assumed spiral, which is second to small fragments in terms of dust manageability.

The cut dust shape observed at the position 1 mm above the bottom face (B surface) assumed a strip shape.

The strip-shaped cut dust exhibits the worst dust manageability, and is entangled with a turning tool or is aggregated as cotton-like matter in a cutting machine. Thus, in order to prevent involvement of the cut dust in a lathe head, a machine must be stopped frequently so as to remove the cut dust, leading to deterioration of productivity and generation of scratches on products due to the involved cut dust.

The cut dust shape observed in the material of Comparative Example 1 assumed a strip shape, and the cut dust had poor manageability.

Mechanical Property Test

The ingots of Example 1 and Comparative Example 1 were homogenized at 505° C. for six hours and aged under the specific conditions shown in Table 3 above.

From each of the top surface (T surface), intermediate surface and the bottom face (B surface) of the material for plastic working, where silicon grain size was measured, a test piece of specific size and shape was obtained in accordance with a nominal size of 0.113 inch specified by "E8-99, FIG. 8" of ASTM standards.

Each test piece was subjected to a tensile test by use of autograph (product of Shimadzu Corporation) at a tensile speed of 1 m/min.

Evaluation items were tensile strength, 0.2% yield strength and elongation.

Table 27 below shows the test results of the material of Example 1, and Table 28 below shows the test results of the material of Comparative Example 1.

TABLE 27

| | | |
|---|---|---|
| Tensile strength (MPa) | Top surface | 360 |
| | Intermediate | 369 |
| | Bottom surface | 379 |
| 0.2% Yield strength (MPa) | Top surface | 304 |
| | Intermediate | 308 |
| | Bottom surface | 311 |
| Elongation (%) | Top surface | 6.7 |
| | Intermediate | 8.1 |
| | Bottom surface | 9.8 |

TABLE 28

| | |
|---|---|
| Tensile strength (MPa) | 377 |
| 0.2% Yield strength (MPa) | 310 |
| Elongation (%) | 9.6 |

In the case of the ingot of Example 1, no remarkable difference in tensile strength and 0.2% yield strength was observed between the top surface and the bottom face, but elongation was small on the top surface side and particularly great on the bottom face side.

Thus, toughness on the bottom face side was high, and the value thereof was approximately equivalent to that of the ingot of Comparative Example 1.

According to the results of the above tests, the material for plastic working obtained in Example 1 shows variations in terms of cut dust manageability and mechanical characteristics at positions in the thickness direction, even though the alloy composition is uniform.

In other words, the present invention provides a material, the top surface portion of which exhibits excellent machinability and wear resistance and the bottom face portion of which exhibits, by virtue of dense metallographic structure, toughness (high elongation among other mechanical characteristics).

Such a material for plastic working endowed with these properties can be employed in either orientation in accordance with the use of the resultant product, making full use of the strong points of the respective portions.

EXAMPLE 2

Figure 9:
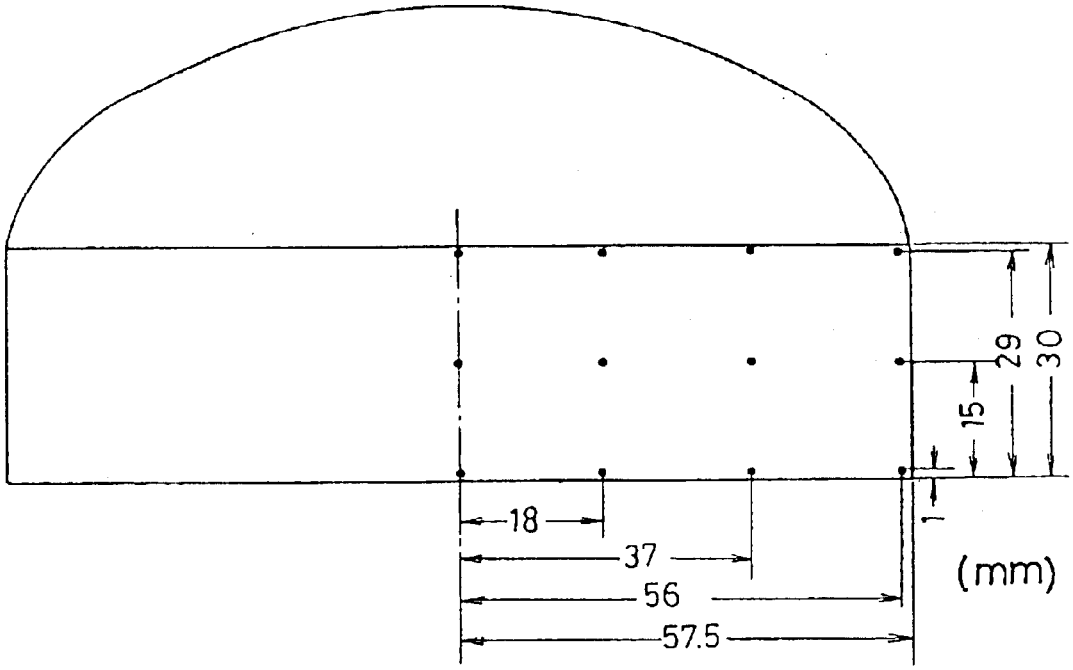
FIG. 9 shows the shape of the ingot cast in Examples 2 to 4.

Using a casting apparatus 10 shown in FIG. 1, ingots 115 mm in diameter: and 30 mm in thickness shown in FIG. 9 were produced by casting.

The ingots were produced under casting conditions shown in Table 29 below, from alloy 2 having the chemical components (mass %) shown in Table 1 above.

TABLE 29

| Items | Note |
|---|---|
| 1. Temperature of molten metal in reservoir | 740° C. |
| 2. Material of mold and reservoir | Lumiboard |
| 3. Difference between levels of molten metal in reservoir and mold cavity just before stopper is closed | 150 mm |
| 4. Temperature of cooling plate before teeming | 100° C. |

TABLE 29-continued

| Items | Note |
|---|---|
| 5. Flow rate of cooling water | 6 L/min |
| 6. Diameter of molten metal inlet | 12 mm |
| 7. Atmospheric temperature within electric furnace | 770° C. |
| 8. Temperature of partition and side wall | 680° C. |
| 9. Casting procedure | |
| 1) Teeming | Stopper closed in 15 sec. |
| 2) Cooling plate | Water cooling initiated at 500° C. |
| 3) Cooling plate | Water cooling terminated at 100° C. |
| 4) Cooling plate | Cooling plate descending at 150° C. |
| 5) Removal of material | Spontaneous falling |

The cast ingots were homogenized at 500° C. for six hours and aged under the specific conditions shown in Table 30 below.

TABLE 30

| | |
|---|---|
| Solid solution treatment temperature | 500° C. |
| Solid solution treatment time | 2 hours |
| Tempering temperature | 170° C. |
| Tempering treatment time | 8 hours |

Method of Measuring Cooling Rate

Twelve thermocouples (represented by black dots in FIG. 9) were set in position for measuring the cooling rate of metal material during casting.

In the same manner as in Example 1, the change in temperature of molten metal was measured and the cooling rate was calculated.

Table 31 below shows the results of cooling rate measurement, and Table 32 below shows the normalized cooling rate with respect to the cooling rate measured at a point 1 mm above the bottom face (B surface).

TABLE 31

| | | Distance from the center in the radial direction (mm) | | | |
|---|---|---|---|---|---|
| | | 0 | 18 | 37 | 56 |
| Distance from the bottom surface in the thickness direction (mm) | 29 | 28.41 | 4.32 | 4.36 | 4.11 |
| | 15 | 5.73 | 5.48 | 5.12 | 4.81 |
| | 1 | 7.58 | 7.89 | 8.12 | 8.64 |

TABLE 32

| | | Distance from the center in the radial direction (mm) | | | |
|---|---|---|---|---|---|
| | | 0 | 18 | 37 | 56 |
| Distance from the bottom surface in the thickness direction (mm) | 29 | 3.75 | 0.55 | 0.54 | 0.48 |
| | 15 | 0.76 | 0.69 | 0.63 | 0.56 |
| | 1 | 1.00 | 1.00 | 1.00 | 1.00 |

As is understood from Tables 31 and 32, results similar to those of Example 1 were obtained.

COMPARATIVE EXAMPLE 2

Using a molten metal identical to that of Example 2 and the continuous casting method as disclosed in JP-B SHO 54-42847, a continuous cast rod was produced under the casting conditions shown in Table 33 below. The rod was cut into pieces 30 mm in thickness.

TABLE 33

| Items | Note |
|---|---|
| 1. Header overhang length | 10 mm |
| 2. Temperature of molten metal | 720° C. |
| 3. Flowing rate of cooling water | 4 L/min |
| 4. Casting rate | 170 mm/min |
| 5. Lubricant | Castor oil |
| 6. Flow rate of lubricant | 1 L/min |
| 7. Type of gas | Air |
| 8. Flow rate of gas | 0.3 L/min |

The cut pieces were homogenized under the same conditions as in Example 2, specifically at 500° C. for six hours, and aged under the specific conditions shown in Table 30 above.

The thus-cast ingots of Example 2 and Comparative Example 2 were cut to produce test pieces for observation of metallographic structure, hardness measurement and resistance measurement.

In the case of Example 2 the test pieces were prepared by cutting the cast ingots at a position 30 mm inside the periphery in the direction identical with the solidification direction. In the case of Comparative Example 2, the test pieces were prepared by cutting the cast ingots at a position 30 mm inside the cast surface in the direction parallel to the casting direction.

Observation of Metallographic Structure

In Example 2, the eutectic silicon grain size and the percent area occupancy thereof were measured at five points located 30 mm inside the periphery (27.5 mm from the center) of each ingot, specifically at 1 mm, 6 mm, 15 mm, 24 mm and 29 mm from the bottom face (B surface) toward the top surface (T surface).

The observation was performed in the same manner as in Example 1 (in respect of the finish-polishing of the test sample, image analysis processor for measuring the grain size, measuring method, parameters of the grain size, etc.).

Table 34 below shows measurements in terms of HEYWOOD diameter and average MAXLNG ($\mu$m) of the eutectic silicon grains at various points in the ingot of Example 2.

Table 35 below shows values of the percent area occupancy (%) of the eutectic silicon grains at various points in the ingot of Example 2.

TABLE 34

| | Distance from the bottom surface (mm) | | | | |
|---|---|---|---|---|---|
| | 1 | 6 | 15 | 24 | 29 |
| HEYWOOD diameter | 2.01 | 2.33 | 2.89 | 3.63 | 4.11 |
| MAXLNG | 2.78 | 3.89 | 5.09 | 6.32 | 7.04 |

TABLE 35

| | Distance from the bottom surface (mm) | | | | |
|---|---|---|---|---|---|
| | 1 | 6 | 15 | 24 | 29 |
| Eutectic Si | 9.5 | 9.5 | 9.9 | 10.0 | 10.1 |

As was in Example 1, the grain size of the eutectic silicon grains became coarser from the bottom face (B surface) to the top surface (T surface).

Although the percent area occupancy (%) of the eutectic silicon grains increased slightly from the bottom face (B surface) to the top surface (T surface), the percent area occupancy was substantially at the same level.

The above measurements were reduced to the normalized values with respect to the values measured at the bottom face (B surface) for the purpose of re-evaluation. Table 36 below shows the normalized grain size and the normalized maximum length of the eutectic silicon crystals. Table 37 below shows the normalized percent area occupancy of the eutectic silicon grains.

TABLE 36

| | Distance from the bottom surface (mm) | | | | |
|---|---|---|---|---|---|
| | 1 | 6 | 15 | 24 | 29 |
| HEYWOOD diameter | 1.0 | 1.21 | 1.4 | 1.8 | 2.01 |
| MAXLNG | 1.0 | 1.4 | 1.8 | 2.3 | 2.5 |

TABLE 37

| | Distance from the bottom surface (mm) | | | | |
|---|---|---|---|---|---|
| | 1 | 6 | 15 | 24 | 29 |
| Eutectic Si | 1.00 | 1.00 | 1.04 | 1.05 | 1.06 |

The HEYWOOD diameter and average MAXLNG of the eutectic silicon grains measured at the top surface (T surface) were 2.0 times and 2.5 times, respectively, those measured at the bottom face (B surface).

There was little difference in the percent area occupancy of the eutectic silicon grains at various points measured, in the thickness direction, on the top surface (T surface) side and on the bottom face (B surface) side. The grain size of the eutectic silicon crystals was generally smaller as compared with the case of Example 1.

Such a result was obtained through addition of strontium (Sr), serving as a crystal-size-reducing agent for the eutectic silicon, to the molten metal in advance.

In the case of the ingot of Comparative Example 2, there was no difference in size and distribution of the silicon grains between the top and bottom faces of the blank. The HEYWOOD diameter of the eutectic silicon crystals at the observed location from the cast surface was 2.13 $\mu$m, and the MAXLNG of the eutectic silicon at the observed location was 2.94 $\mu$m. The percent area occupancy of the eutectic silicon grains at the observed location was 9.80%.

The grain size and the percent area occupancy of the eutectic silicon grains of Comparative Example 2 were equivalent to the grain size distribution in the ingot of Example 1 measured at the position approximately 6 mm above the bottom face (B surface).

Measurement of Hardness

Hardness of a portion of the test piece that underwent the below-described friction-wear test was measured by means of a Rockwell hardness tester (B-scale) (HRB).

Friction-Wear Test:

Friction-wear test of an ingot was performed by use of the test apparatus and under the conditions shown in Table 38 below. Wear resistance on the top surface (T surface) side and that on the bottom face (B surface) side were evaluated.

TABLE 38

| Items | Details |
|---|---|
| 1) Test apparatus | Wear tester Model TRI-S500 (Takachiho Seiki) |
| 2) Test method | Pin-on-disc |
| 3) Disc material | ADC12 Die cast material |
| 4) Lubricant | Mission oil |
| 5) Load applied | 5 kgf |
| 6) Sliding rate | 0.25 m/sec |
| 7) Sliding time | 60 min |
| 8) Shape of pin | 7.9 mm in diameter and 20 mm in height |

A test piece was obtained through mechanical cutting from a position where the test piece was prepared for observation of metallographic structure, namely 30 mm from the periphery, to thereby prepare a columnar piece (pin-shaped test piece) (dimensions shown in Table 38 above) including an axis parallel to the solidification direction. The test piece was cut such that the surface 1 mm beneath the top surface (T surface) (i.e., 29 mm above the bottom face (B surface)) and the surface 1 mm above the bottom face (B surface) were developed to thereby serve as the friction test surfaces.

The amount of wear (decrease in pin length) caused by friction at each surface was measured.

Table 39 below shows hardness and the amount of wear of the pin of Example 2. The hardness HRB and the amount of wear of the pin of Comparative Example 2 were 76.5 and 42 $\mu$m, respectively.

TABLE 39

| Position of measurement | Hardness (HRB) | Amount of wear of the pin ($\mu$m) |
|---|---|---|
| 1 mm below the top surface | 76.8 | 21 |
| 1 mm above the bottom surface | 76.1 | 45 |

Little difference was observed between the hardness at points measured in the thickness direction of the ingot of Example 2 and the hardness of the ingot of Comparative Example 2.

Little difference in amount of wear was observed between the bottom face (B surface) of the pin of Example 2 and that of Comparative Example 2. However, the amount of wear at the top surface (T surface) of the pin of Example 2 is less than that of Comparative Example 2, and thus the top surface (T surface) of the pin of Example 2 evidently exhibits greater wear-resistance.

EXAMPLE 3

By use of a casting apparatus 10 shown in FIG. 1, ingots 115 mm in diameter and 30 mm in thickness were produced by casting in the same manner as in Example 2.

The ingots were produced under casting conditions shown in Table 40 below from alloy 3 (JIS AC4C) having the chemical components (mass %) shown in Table 1 above.

TABLE 40

| Items | Note |
|---|---|
| 1. Temperature of molten metal in reservoir | 750° C. |
| 2. Material of mold and reservoir | Lumiboard |
| 3. Difference between levels of molten metal in reservoir and mold cavity just before stopper is closed | 150 mm |

TABLE 40-continued

| Items | Note |
|---|---|
| 4. Temperature of cooling plate before teeming | 100° C. |
| 5. Flow rate of cooling water | 6 L/min |
| 6. Diameter of molten metal inlet | 12 mm |
| 7. Atmospheric temperature within electric furnace | 780° C. |
| 8. Temperature of partition and side wall | 700° C. |
| 9. Casting procedure | |
| 1) Teeming | Stopper closed in 15 sec. |
| 2) Cooling plate | Water cooling initiated at 500° C. |
| 3) Cooling plate | Water cooling terminated at 100° C. |
| 4) Cooling plate | Cooling plate descending at 150° C. |
| 5) Removal of material | Spontaneous falling |

The cast ingots were homogenized at 525° C. for six hours and aged under the specific conditions shown in Table 41 below.

TABLE 41

| | |
|---|---|
| Solid solution treatment temperature | 525° C. |
| Solid solution treatment time | 2 hours |
| Tempering temperature | 170° C. |
| Tempering treatment time | 8 hours |

Method of Measuring Cooling Rate

Twelve thermocouples (represented by black dots in FIG. 9) were set in position for measuring the cooling rate of metal material during casting. The change in temperature of molten metal was measured and the cooling rate was calculated in the same manner as in Example 1.

Table 42 below shows the results of cooling rate measurement, and Table 43 below shows the normalized cooling rate with respect to the cooling rate measured at a point 1 mm above the bottom face (B surface).

TABLE 42

| | | Distance from the center in radial direction (mm) | | | |
|---|---|---|---|---|---|
| | | 0 | 18 | 37 | 56 |
| Distance from the bottom surface in thickness direction (mm) | 29 | 49.73 | 7.79 | 7.62 | 7.43 |
| | 15 | 10.59 | 9.81 | 9.12 | 8.51 |
| | 1 | 14.22 | 14.67 | 14.88 | 15.06 |

TABLE 43

| | | Distance from the center in radial direction (mm) | | | |
|---|---|---|---|---|---|
| | | 0 | 18 | 37 | 56 |
| Distance from the bottom surface in thickness direction (mm) | 29 | 3.50 | 0.53 | 0.51 | 0.49 |
| | 15 | 0.74 | 0.67 | 0.61 | 0.57 |
| | 1 | 1.00 | 1.00 | 1.00 | 1.00 |

As is understood from Tables 42 and 43, although the values of the cooling rate were generally greater, results similar to those of Examples 1 and 2 were obtained.

Observation of Metallographic Structure

In Example 3, the eutectic silicon grain size and the percent area occupancy thereof were measured at five points located 30 mm inside the periphery (27.5 mm from the center) of each ingot, specifically at 1 mm, 6 mm, 15 mm, 24 mm and 29 mm from the bottom face (B surface) toward the top surface (T surface).

The observation was performed in the same manner as in Example 1 (in respect of the finish-polishing of the test sample, image analysis processor for measuring the grain size, measuring method, parameters of the grain size, etc.)

Table 44 below shows measurements in terms of HEYWOOD diameter and average MAXLNG ($\mu$m) of the eutectic silicon grains at various points in the ingot of Example 3.

Table 45 below shows values of the percent area occupancy (%) of the eutectic silicon grains at various points in the ingot of Example 3.

TABLE 44

| | Distance from the bottom surface (mm) | | | | |
|---|---|---|---|---|---|
| | 1 | 6 | 15 | 24 | 29 |
| HEYWOOD diameter | 1.91 | 2.22 | 2.81 | 3.21 | 3.74 |
| MAXLNG | 1.84 | 2.76 | 3.68 | 4.51 | 5.36 |

TABLE 45

| | Distance from the bottom surface (mm) | | | | |
|---|---|---|---|---|---|
| | 1 | 6 | 15 | 24 | 29 |
| Eutectic Si | 8.6 | 8.5 | 8.6 | 8.4 | 8.6 |

As was in Example 1, the grain size of the eutectic silicon grains became coarser from the bottom face (B surface) to the top surface (T surface).

The percent area occupancy (%) of the eutectic silicon grains was substantially at the same level.

The above measurements were reduced to the normalized values with respect to the values measured at the bottom face (B surface) for the purpose of re-evaluation. Table 46 below shows the normalized grain size and the normalized maximum length of the eutectic silicon crystals. Table 47 below shows the normalized percent area occupancy (%) of the eutectic silicon grains.

TABLE 46

| | Distance from the bottom surface (mm) | | | | |
|---|---|---|---|---|---|
| | 1 | 6 | 15 | 24 | 29 |
| HEYWOOD diameter | 1.0 | 1.2 | 1.5 | 1.7 | 2.0 |
| MAXLNG | 1.0 | 1.5 | 2.0 | 2.5 | 2.9 |

TABLE 47

| | Distance from the bottom (mm) | | | | |
|---|---|---|---|---|---|
| | 1 | 6 | 15 | 24 | 29 |
| Eutectic Si | 1.00 | 0.99 | 1.00 | 0.98 | 1.00 |

The HEYWOOD diameter and MAXLNG of the eutectic silicon grains measured at the top surface (T surface) were 2.0 times and 2.9 times, respectively, those measured at the bottom face (B surface).

Little difference was observed in the percent area occupancy of the eutectic silicon grains at various points measured, in the thickness direction, on the top surface (T surface) side and on the bottom face (B surface) side. The grain size of the eutectic silicon crystals was generally smaller as compared with the case of Example 1.

Measurement of Hardness

Hardness of a portion of the test piece that underwent the below-described friction-wear test was measured using a Rockwell hardness tester (B-scale) (HRB).

Friction-Wear Test

Friction-wear test of an ingot was performed by use of the test apparatus and under the conditions shown in Table 38 above. Wear resistance on the top surface (T surface) side and that on the bottom face (B surface) side were evaluated.

A test piece was obtained through mechanical cutting from a position where the test piece was prepared for observation of metallographic structure, namely a peripheral location (30 mm from the original periphery), to thereby prepare a columnar piece (pin-shaped test piece) (dimensions shown in Table 38 above) including an axis parallel to the solidification direction. The test piece was cut such that the surface 1 mm beneath the top surface (T surface) (i.e., 29 mm above the bottom face (B surface)) and the surface 1 mm above the bottom face (B surface) were developed to thereby serve as the friction test surfaces.

The amount of wear (decrease in pin length) caused by friction at each surface was measured.

Table 48 below shows hardness and the amount of wear of the pin of Example 3.

The top surface (T surface) of the ingot of Example 3 clearly exhibited excellent wear-resistance.

TABLE 48

| Position of measurement | Hardness (HRB) | Amount of wear of the pin (μm) |
|---|---|---|
| 1 mm below the top surface | 58.8 | 54.8 |
| 1 mm above the bottom surface | 59.7 | 89.3 |

EXAMPLE 4

By use of a casting apparatus 10 shown in FIG. 1, ingots (diameter: 115 mm, thickness 30 mm) were produced by casting.

The ingots were produced under casting conditions shown in Table 49 below, from alloy 4 (A390) having a chemical composition (mass %) shown in Table 1.

In the mold cavity, twelve thermocouples (represented by black dots in FIG. 9) were set for measuring the cooling rate of metal material during casting.

The cast ingots were homogenized at for, and aged under the specific conditions shown in Table 50 below.

TABLE 49

| Items | Note |
|---|---|
| 1. Temperature of molten metal in reservoir | 800° C. |
| 2. Material of mold and reservoir | SiC |
| 3. Difference between levels of molten metal in reservoir and mold cavity just before stopper is closed | 150 mm |
| 4. Temperature of cooling plate before teeming | 100° C. |
| 5. Flow rate of cooling water | 6 L/min |
| 6. Diameter of molten metal inlet. | 12 mm |
| 7. Atmospheric temperature within electric furnace | 830° C. |
| 8. Temperature of partition and side wall | 730° C. |
| 9. Casting procedure | |
| 1) Teeming | Stopper closed in 18 sec. |

TABLE 49-continued

| Items | Note |
|---|---|
| 2) Cooling plate | Water cooling initiated at 500° C. |
| 3) Cooling plate | Water cooling terminated at 100° C. |
| 4) Cooling plate | Cooling plate descending at 150° C. |
| 5) Removal of material | Spontaneous falling |

TABLE 50

| | |
|---|---|
| Solid solution treatment temperature | 490° C. |
| Solid solution treatment time | 2 hours |
| Tempering temperature | 170° C. |
| Tempering treatment time | 8 hours |

Method of Measuring Cooling Rate

Twelve thermocouples (represented by black dots in FIG. 9) were set in position for measuring the cooling rate of metal material during casting. The change in temperature of molten metal was measured and the cooling rate was calculated in the same manner as in Example 1.

Table 51 below shows the results of the cooling rate measurement.

Table 52 below shows the normalized cooling rate with respect to the cooling rate measured at a point 1 mm above the bottom face (B surface).

TABLE 51

| | | Distance from the center in radial direction (mm) | | | |
|---|---|---|---|---|---|
| | | 0 | 18 | 37 | 56 |
| Distance from the bottom surface in thickness direction (mm) | 29 | 9.26 | 2.16 | 2.86 | 3.88 |
| | 15 | 2.32 | 2.56 | 3.11 | 4.36 |
| | 1 | 3.42 | 3.59 | 4.26 | 5.58 |

TABLE 52

| | | Distance from the center in radial direction (mm) | | | |
|---|---|---|---|---|---|
| | | 0 | 18 | 37 | 56 |
| Distance from the bottom surface in thickness direction (mm) | 29 | 2.71 | 0.60 | 0.67 | 0.70 |
| | 15 | 0.68 | 0.71 | 0.73 | 0.78 |
| | 1 | 1.00 | 1.00 | 1.00 | 1.00 |

As is understood from Tables 51 and 52, results similar to that of Example 1 were obtained.

Observation of Metallographic Structure

In Example 4, the eutectic silicon grain size, primary silicon crystal grain size and percent area occupancy thereof were measured at five points located 30 mm inside the periphery (27.5 mm from the center) of each ingot, specifically at 1 mm, 6 mm, 15 mm, 24 mm and 29 mm from the bottom face (B surface) toward the top surface (T surface)

The observation was performed in the same manner as in Example 1 (in respect of the finish-polishing of the test sample, image analysis processor for measuring grain size, measuring method, parameters of the grain size, etc.).

Table 53 below shows measurements in terms of HEYWOOD diameter and average MAXLNG (μm) of eutectic silicon grains at various points in the ingot of Example 4.

Table 54 below shows measurements in terms of HEYWOOD diameter and average MAXLNG (μm) of primary silicon crystal grains at various points in the ingot of Example 4.

Table 55 below shows percent area occupancy (%) of the eutectic silicon grains at various points in the ingot of Example 4, percent area occupancy (%) of the primary silicon crystal grains at various points in the ingot of Example 4 and percent area occupancy (%) of the entirety thereof.

TABLE 53

| | Distance from the bottom surface (mm) | | | | |
|---|---|---|---|---|---|
| | 1 | 6 | 15 | 24 | 29 |
| HEYWOOD diameter | 2.75 | 3.33 | 4.69 | 5.82 | 6.92 |
| MAXLNG | 3.72 | 4.99 | 7.94 | 11.2 | 14.33 |

TABLE 54

| | Distance from the bottom surface (mm) | | | | |
|---|---|---|---|---|---|
| | 1 | 6 | 15 | 24 | 29 |
| HEYWOOD diameter | 15.20 | 16.4 | 16.7 | 17.52 | 18.84 |
| MAXLNG | 18.61 | 22.41 | 25.45 | 28.12 | 32.21 |

TABLE 55

| | Distance from the bottom surface (mm) | | | | |
|---|---|---|---|---|---|
| | 1 | 6 | 15 | 24 | 29 |
| Eutectic Si | 11.2 | 10.4 | 10.4 | 8.9 | 7.9 |
| Primary Si | 7.5 | 8.9 | 10.0 | 10.6 | 11.3 |
| Total | 18.7 | 19.3 | 20.4 | 19.5 | 19.2 |

Values of the percent area occupancy (%) of the sum of both types of silicon measured in the thickness direction were almost the same. However, the percent area occupancy (%) of the eutectic silicon grains gradually decreased from the bottom face (B surface) to the top surface (T surface), whereas the percent area occupancy (%) of the primary silicon crystal grains gradually increased from the bottom face (B surface) to the top surface (T surface).

A conceivable reason for this would be that, on the top surface (T surface) side of the ingot, growth of the primary silicon crystal dominated growth of the eutectic silicon.

Measurement of Hardness

Hardness of a portion of the test piece that underwent the below-described friction-wear test was measured by means of a Rockwell hardness tester (B-scale) (HRB).

Friction-Wear Test

Friction-wear test of an ingot was performed by use of the test apparatus and under the conditions shown in Table 56 below. Wear resistance on the top surface (T surface) side and that on the bottom face (B surface) side were evaluated.

TABLE 56

| Items | Details |
|---|---|
| 1) Test apparatus | Wear tester Model TRI-S500 (Takachiho Seiki) |
| 2) Test method | Pin-on-disc |
| 3) Disc material | FC2O |

TABLE 56-continued

| Items | Details |
|---|---|
| 4) Lubricant | Mission oil |
| 5) Load applied | 5 kgf |
| 6) Sliding rate | 0.25 m/sec |
| 7) Sliding time | 60 mm |
| 8) Shape of pin | 7.9 mm in diameter and 20 mm in height |

A test piece was obtained through mechanical cutting from a position where the test piece was prepared for observation of metallographic structure, specifically a peripheral location (30 mm from the original periphery), to thereby prepare a columnar piece (pin-shaped test piece) (dimensions shown in Table 38 above) including an axis parallel to the solidification direction. The test piece was cut such that the surface 1 mm beneath the top surface (T surface) (i.e., 29 mm above the bottom face (B surface)) and the surface 1 mm above the bottom face (B surface) were developed to thereby serve as the friction test surfaces.

The amount of wear (decrease in pin length) caused by friction at each surface was measured.

Table 57 below shows hardness and the amount of wear of the pin of Example 4.

The top surface (T surface) of the ingot of Example 4 clearly exhibited excellent wear-resistance.

TABLE 57

| Position of measurement | Hardness (HRB) | Amount of wear of the pin (μm) |
|---|---|---|
| 1 mm below the top surface | 81.3 | 15.3 |
| 1 mm above the bottom surface | 82.4 | 24.5 |

As described hereinabove, according to one embodiment of the present invention, a material for plastic working having an excellent function at a selective site can be provided by grading the inside component distribution and the morphology of the metallographic structure from the cooling face (bottom face) to the opposite surface (top surface).

For example, when a silicon-containing alloy is processed to form the above material for plastic working, the wear resistance on the top surface side can be enhanced as compared with its original value, while the strength of the entirety thereof is maintained at an original level, by virtue of variation in morphology of metallographic structure.

Therefore, use of the material for plastic working of the present invention can produce, from a material in which a specific property is imparted exclusively to a portion that requires that property, products endowed with a predetermined property.

Applications of the material of the present invention for plastic working will next be described.

One exemplified application of the above material in which properties of both the top surface side and the bottom face side are employed is a piston for an internal combustion engine. In the piston, the wear resistance and machinability of the top surface side of the material is applied to its piston head side and the toughness of the bottom face of the material is applied to its skirt portion.

Another exemplified application of the above material in which the property of the top surface side is employed is a sleeve for an internal combustion engine. The wear resistance of the top surface side of the material is applied to the inside of the sleeve to thereby maintain toughness of the entirety of the sleeve.

Other exemplified applications of the above material in which the property of the bottom face side is employed include, in relation to a scroll-type compressor, a scroll having a blade-side portion formed of the material and attaining a prolonged service life of a cutter and enhanced toughness and a Wobble plate of a Wobble plate compressor, maintaining wear resistance and having enhanced toughness of a ball pocket portion, thereby enhancing crimpability.

In the aforementioned embodiments, only aluminum-silicon alloys have been mentioned. However, other alloys containing a nonferrous element, such as aluminum, zinc or magnesium, may also be used.

When the property of the top surface (T surface) side is undesirable, the top surface (T surface) may be removed to a desired thickness to thereby provide a material for plastic working having a desired property.

In addition, a protruded portion may be provided in a portion of the top surface (T surface) side corresponding to the molten metal inlet portion or in another portion, instead of cutting out the entirety of the top surface (T surface) as described above, so that a portion having an undesired property is confined to the protruded portion, and the protrusion may be removed through cutting or surface-grinding.

Thus, when a protruded portion is provided on a material for plastic working, the material may be formed into a product while the protruded portion being retained, which is then removed through cutting or grinding.

INDUSTRIAL APPLICABILITY

As described hereinabove, according to the present invention, a material for plastic working having an excellent function at a selective site can be provided by grading the inside component distribution and the morphology in relation to the metallographic structure from the cooling face (bottom face) to the opposite surface (top surface).

The material of the present invention for plastic working ensures to take advantage of difference in metallographic morphology of the material. For example, in the case of a silicon-containing alloy, the wear resistance on the top surface side can be enhanced as compared with its original value, while the strength of the entirety thereof is maintained at an original level, by virtue of variation in morphology of metallographic structure.

In other words, if the wear resistance on the top surface side is maintained at an original level, the total amount of silicon required can be reduced to thereby enhance the toughness of the entire material including the bottom face side.

Therefore, use of the material for plastic working of the present invention can produce, from a material in which a specific property is imparted exclusively to a portion that requires that property, products endowed with a predetermined property.

In addition, regulating the cooling rate and solidification rate enables segregation of components to be controlled.

By controlling the component segregation, a positive concentration gradient (of an element undergoing eutectic reaction with aluminum) from the bottom face to the top surface is provided to the component distribution in a portion except for a columnar portion having a diameter 1.5 times that of a molten metal inlet. Thus, differences in physical properties, such as mechanical characteristics and thermal expansion coefficient between the top surface and the bottom face, can be further increased.

For example, chemical elements which can enhance high-temperature strength, such as titanium (Ti), chromium (Cr), vanadium (V), zirconium (Zr), manganese (Mn), silver (Ag) and scandium (Sc), are added to aluminum singly or in combination to thereby enhance properties of the top surface or the bottom face as compared with the counter surface.

What is claimed is:

1. A method for producing a material for plastic working in a mold having a mold cavity partially defined by an end surface of a stopper for closing a molten metal inlet, comprising the steps of teeming molten metal into mold cavity through the molten metal inlet and initiating cooling the molten metal from a time before closing the molten metal inlet to terminate the teeming to thereby attain unidirectional solidification of the molten metal, wherein a cooling rate of the molten metal is monotonously reduced in a direction from a cooled face of the mold to an opposing face of the mold, except for a columnar portion which is coaxial with and present beneath the molten metal inlet and has a diameter 1.5 times to twice that of the molten metal inlet.

2. The method for producing a material for plastic working as described in claim 1, wherein the columnar portion has a diameter 1.5 times that of the molten metal inlet.

3. The method for producing a material for plastic working as described in claim 1, wherein the columnar portion has a diameter twice that of the molten metal inlet.

4. The method for producing a material for plastic working as described in any one of claims 1 to 3, wherein the molten metal is aluminum alloy.

5. The method for producing a material for plastic working as described in any one of claims 1 to 3, wherein the molten metal is aluminum-silicon-based alloy.

* * * * *